United States Patent [19]

Carlin

[11] 4,147,601

[45] * Apr. 3, 1979

[54] ELECTROLYTIC PRODUCTION OF HYDROBROMIC ACID

[75] Inventor: William W. Carlin, Portland, Tex.

[73] Assignee: PPG Industries, Inc., Pittsburgh, Pa.

[ * ] Notice: The portion of the term of this patent subsequent to Oct. 11, 1994, has been disclaimed.

[21] Appl. No.: 819,782

[22] Filed: Jul. 28, 1977

[51] Int. Cl.[2] ..... C25B 1/22
[52] U.S. Cl. ..... 204/103
[58] Field of Search ..... 204/103

[56] References Cited

U.S. PATENT DOCUMENTS

| | | | |
|---|---|---|---|
| 2,073,664 | 3/1937 | Weisberg et al. | 204/274 |
| 3,165,460 | 1/1965 | Zang et al. | 204/301 |
| 3,787,304 | 1/1974 | Chlanda et al. | 204/103 |
| 4,053,376 | 10/1977 | Carlin | 204/103 |

FOREIGN PATENT DOCUMENTS

| | | | |
|---|---|---|---|
| 254490 | 11/1967 | U.S.S.R. | 204/103 |
| 297576 | 5/1971 | U.S.S.R. | 204/103 |

*Primary Examiner*—R. L. Andrews
*Attorney, Agent, or Firm*—Richard M. Goldman

[57] ABSTRACT

Disclosed is a method of producing aqueous bromide solutions. According to the disclosed method, bromine is electrolyzed in an aqueous catholyte and hydrogen bromide is formed.

10 Claims, 1 Drawing Figure

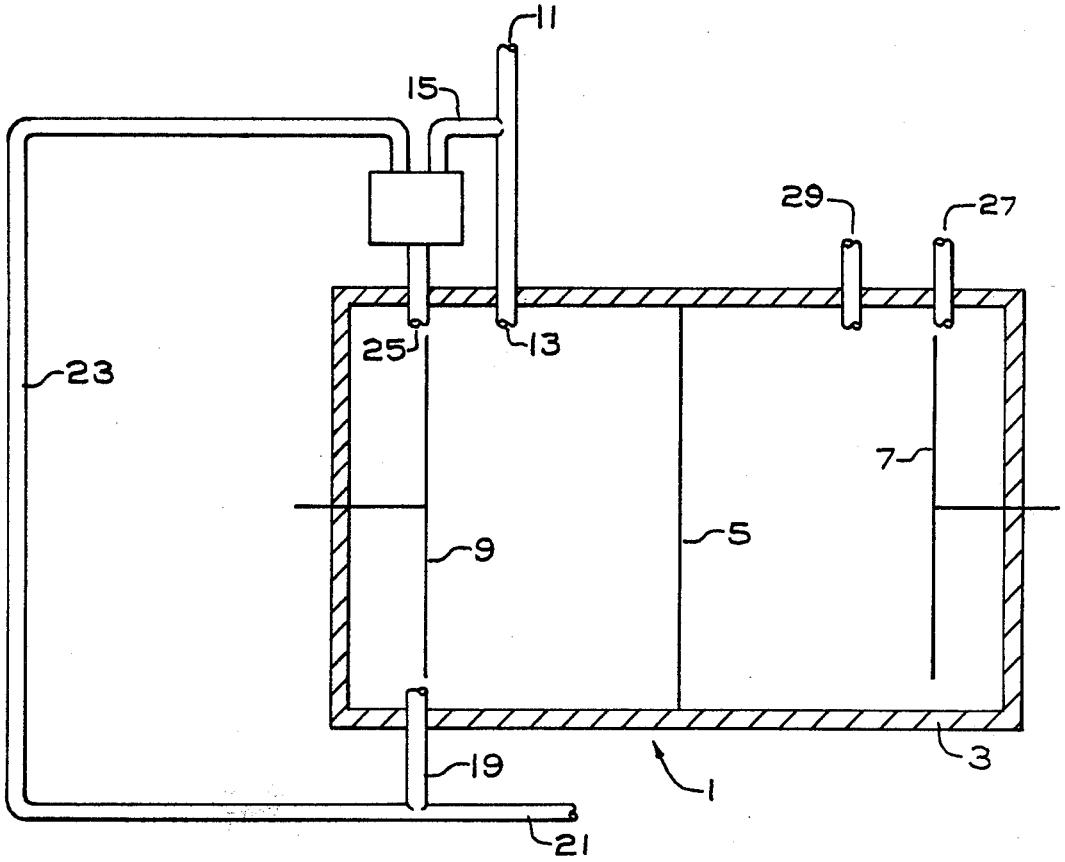
11
15
29
27
25
13
23
7
9
5
19
3
1
21

ELECTROLYTIC PRODUCTION OF HYDROBROMIC ACID

DESCRIPTION OF THE INVENTION

Aqueous solutions of hydrogen bromide find use as a solvent for ore minerals, for cleaving alkoxy and phenoxy compounds, the manufacture or inorganic bromides, the replacement of hydroxyl groups on organic molecules, and the direct hydrobromination of olefines. Hydrogen bromide is also used as an alkylation catalyst. Particularly preferred are aqueous solutions of hydrogen iodide containing from about 40 to about 48 or more weight percent hydrogen bromide.

Aqueous hydrogen bromide solutions have generally been prepared by the reaction of bromine with sulfur or phosphorus and water.

It has now been found that aqueous bromide solutions, for example, aqueous hydrogen bromide solutions, can be produced electrolytically in an electrolytic cell by feeding bromine to an aqueous catholyte liquor, passing current from an anode through an electrically conductive anolyte liquor, a diaphragm or membrane, and an electrically conductive catholyte liquor to the cathode, and evolving the bromide in the catholyte.

Preferably, a permionic membrand rather than a permeable diaphragm is interposed between the anolyte liquor and the catholyte liquor. Hydrogen bromide may be present in the catholyte liquor at start-up to provide some solubility for the bromine.

The anolyte itself is preferably an aqueous solution of an acid so that hydrogen ion can pass through the membrane from the anolyte to the catholyte and an anodic co-product such as chlorine or oxygen is provided.

THE FIGURE

The FIGURE shows a schematic view of an electrolytic cell divided into an anolyte compartment and a catholyte compartment by a permionic membrane. The electrolytic cell further shows anolyte feed means, anolyte gas recovery means, catholyte feed means, and catholyte liquor recovery means.

DETAILED DESCRIPTION OF THE INVENTION

Hydrogen bromide is produced in an electrolytic process yielding an aqueous solution of hydrobromic acid. Additionally, the aqueous solution of hydrobromic acid may include small amounts of bromine, e.g., bromide ion, $Br_3^-$, in the acid. Preferably, the hydrobromic acid solution contains in excess of 40 weight percent hydrogen bromide, for example, as much as 46 to 48 weight percent hydrobromic acid.

The electrolytic process is carried out in electrolytic cell 1 having an anolyte chamber containing an anode 7 separated from a catholyte chamber containing a cathode 9 by a permionic membrane 5. The permionic membrane will be described more fully hereinafter.

According to the method described herein, an aqueous catholyte liquor is provided. In the operation of a continuous process, a solubilizing amount of hydrogen bromide will be present in the catholyte liquor. However, in a batch process or semi-batch process, the addition of some hydrogen bromide, for example, a solubilizing amount of hydrogen bromide, may be necessary. The concentration of hydrogen bromide in the catholyte liquor after the process has been carried out for some time is a function of the residence time in the catholyte chamber. Frequently, the concentration of hydrogen bromide is in excess of 40 percent, for example, as high as 46 or 48 weight percent.

The concentration of bromine in the catholyte liquor is generally below the solubility limit thereof. However, during start-up of a batch process, the concentration of bromine may be at the solubility limit. The solubility limit of the bromine is a function of the hydrogen bromide concentration as will be more fully described hereinafter. Additionally, bromide may be present as a separate liquid phase within the catholyte chamber, for example, at the start of a batch or semi-batch process.

The saturation concentration of bromine, in grams per liter, is approximately equal to the actual concentration of hydrogen bromine in the aqueous solution, in grams per liter. The values shown in Table I have been reported in the literature for the saturation concentration of bromine in hydrogen bromide solutions at 25° C. in gram moles per liter.

TABLE I

Solubility of Bromine in Aqueous Hydrobromic Acid

| Gram moles per liter | |
|---|---|
| HBr | $Br_2$ |
| 0.052 | 0.2744 |
| 0.104 | 0.3331 |
| 0.208 | 0.4538 |
| 0.416 | 0.6809 |
| 0.832 | 1.1735 |
| 1.664 | 2.1293 |

A "solubilizing amount" of hydrogen bromide is an amount sufficient to provide the desired concentration of bromine in the solution.

An aqueous, electrically conductive anolyte liquor is provided in the anolyte chamber. The anolyte liquor should have an electrical conductivity of greater than about 0.03 $(ohm\text{-}cm)^{-1}$ and preferably greater than about 1.0 $(ohm\text{-}cm)^{-1}$ at a temperature of about 25° C. The electrical conductivity may be higher or lower than the above values depending upon the temperature and the presence or absence of various impurities with deleterious effects.

The anolyte liquor may be provided by an acidic aqueous solution, for example, sulfuric acid, hydrochloric acid, or phosphoric acid. Where the anolyte liquor is provide by an aqueous solution of acid, the acid should preferably be an acid having a useful anodic co-product. Typical acids yielding a co-product include sulfuric acid and phosphoric acid having oxygen as a co-product and hydrochloric acid having chlorine as a co-product. The concentration of the acid should be such as to provide an economical electrical conductivity of the anolyte liquor. Additionally, it may be desirable to minimize water transport from the anolyte to the catholyte, for example, by utilizing a concentrated anolyte liquor. The concentration of the anolyte is a matter or routine experimentation depending upon the design of the cell, the temperature of the electrolyte, the quantity and identity of the impurities in the anolyte, and the desired strength of the iodide solution.

Where the anolyte liquor is sulfuric acid, the concentration thereof is from about 5 to about 40 weight percent and preferably from about 10 to about 35 weight percent, although the actual concentration thereof may be optimized by routine experimentation. Where the electrolyte is hydrochloric acid, the concentration thereof may be about 2 weight percent to a saturated solution, e.g., about 38 weight percent, and preferably from about 5 weight percent to about 38 weight percent.

While it is preferred that the anolyte liquor be an acid so as to provide the migration of hydrogen ions through the permionic membrane, the anolyte liquor may also be a salt where the anodic co-product is as described above and the cathodic product of the process is an iodide salt.

Electrical current is passed through the cell with bromine present in the catholyte liquor. The process may be operated as a batch process, a semi-batch process, or a continuous process. When operated as a batch process, bromine, either in solution or as a separate liquid phase in contact with a saturated solution, or as a liquid, is added to the catholyte liquor. A solubilizing amount of hydrogen bromide is preferably present in the catholyte liquor, e.g., about 44 grams per liter of hydrogen bromides, provides a bromine content in the solution of about 69 grams per liter. As more hydrogen bromide is formed, more of the liquid bromine will be solubilized.

According to an alternative exemplification of this invention, the process may be operated in one of two semi-batch methods. According to one semi-batch method, liquid bromine is added to the catholyte liquor at the beginning of the run and hydrogen bromine is continuously removed from the catholyte chamber to keep the hydrogen bromide and bromine contents of the catholyte liquor at the desired level. At high hydrogen bromide contents, for example, above about 40 weight percent, the bromine concentration may be and preferably is below the saturation amount.

In an alternative semi-batch method of operation, liquid bromine is slowly added to the catholyte liquor while building up the hydrogen bromine concentration thereof, for example, by starting out with about 0.3 grams per liter or less of bromine and feeding more bromine as the hydrogen bromide concentration of the catholyte liquor builds up. Thereafter, either sufficient bromine may be added to keep the bromine concentration at a desired level until a desired hydrogen bromide strength is attained or the catholyte bromine can be depleted as the hydrogen bromide strength builds up.

In the continuous mode of operation, a stoichiometric amount of bromine may be added to the catholyte liquor and the concentration of hydrogen bromide maintained at the desired strength, e.g., at about 40 to 48 weight percent hydrogen bromine, such that no separate liquid phase is present in the catholyte. Where the process is operated continuously, the concentration of hydrogen bromide, after start up, is frequently in excess of 40 weight percent, for example, 46 or 48 weight percent hydrogen bromide and the concentration of bromine may be much lower, for example, as low as 2, 3, 5 or 10 percent. The concentration of bromine should be high enough, however, to avoid the formation of hydrogen at the cathode.

The bromine may be added as a liquid or in solution. Where the bromine is added in solution, it may be added as a saturated bromine solution, as a saturated solution of hydrogen bromide and bromine or as a solution of hydrogen bromide, unsaturated in bromine.

An electrical current is passed from an anode of the cell through the anolyte liquor, the permionic membrane, and the catholyte liquor to a cathode of the cell, evolving hydrogen bromide in the catholyte. This may be carried out with a current density of from about 0.1 ampere per square centimeter to about 1.0 ampere per square centimeter or even as high as the limiting current density of the electrolytic components. That is, the current density is limited at its upper ranges by the limiting current densities for the permionic membrane, the anode, and the cathode. At the limiting current density, voltage increases will not produce an increase in current density. At its lower ranges, the current density is limited by the economics of the cell design.

The electrolyte temperatures may be from about 15° C. up to about the boiling temperature of the catholyte or anolyte liquor.

The electrolytic cell is shown in the FIGURE. As there shown, the electrolytic cell 1 has a body 3 with the interior of the cell divided by a permionic membrane 5 into an anolyte chamber having an anode 7 and a catholyte chamber having a cathode 9. The catholyte chamber has iodine feed means 11 which may be used to feed liquid bromine directly into the catholyte chamber of the cell 1 through the use of line 13. Alternatively, the bromine feed may be through line 15 to a tank 17 where the bromine is solubilized by the withdrawn aqueous hydrogen bromide solution and thereafter fed into the cell through line 25.

The cell further includes hydrobromic acid recovery line 19 through which product hydrobromic acid can be withdrawn through line 21 and recycle hydrobromic acid can be fed through line 23 to tank 17 there to mix with liquid bromine to provide a feed through line 25 to the catholyte chamber of the cell.

Anolyte feed may be through anolyte feed means 27 with coproduct recovery either through line 27 or through a separate recovery line 29.

The anode 7 and anode compartment are preferably fabricated of titanium and titanium alloys such as alloys of titanium with molybdenum, palladium, and yttrium. The body and anode may also be fabricated of lead and lead alloys. According to one exemplification of this invention, the body may be fabricated of glass and have the metal anodes described above.

The cathode and catholyte chamber may be fabricated of stainless steel or lead. The catholyte chamber may further be fabricated of glass and have a metal cathode as described above.

Alternatively, the cell body, including the anode compartment and the cathode compartment, may be fabricated of chlorinated polyvinyl chloride or fiberglass reinforced plastic or fiberglass reinforced chlorendic anhydride type polymers.

In the electrolytic cell used in the practice of this invention, an electrolyte impermeable, ion permeable material, i.e., a permionic membrane, is interposed between the anolyte compartment and the catholyte compartment.

One class of fluorocarbons useful in providing the permionic membranes of this invention are those having the empirical formula;

$$\left(C_mF_{2m}\right)_M\left(CF_2-\underset{\underset{R}{|}}{CF}\right)_N$$

where m is from 2 to 10, the ratio of M to N is sufficient to provide an equivalent weight of from 600 to 2,000 as will be more fully elucidated hereinafter, and R is chosen from the group consisting of;

$$A,\ \left(OCF_2-CF_2\right)_pA$$

where p is from 1 to 3, $$\left(OCF_2-\underset{\underset{Y}{|}}{CF}\right)_p A$$

where p is from 1 to 3 and Y is —F or a perfluoroalkyl having from 1 to 10 carbon atoms, $$\left(OCF_2-\underset{\underset{Y}{|}}{CF}\right)_p\left(O-CF_2-\underset{\underset{R_f}{|}}{CF}\right)A$$

where p is from 1 to 3, *Y* is —F or a perfluoroalkyl having from 1 to 10 carbon atoms, and $R_f$ is —F or a perfluoroalkyl having from 1 to 10 carbon atoms, $$-\phi-A$$

where $\phi$ is an aryl group, and $$\left(CF_2\right)_p A$$

where p is from 1 to 3; and where A is an acid group chosen from the group consisting of;

—$SO_3H$,
—$SO_2NH_2$,
—$CF_2SO_3H$,
—$CF_2SO_2NH_2$,
—$CCl_2SO_3H$,
—$CCl_2SO_2NH_2$,
—$\phi'SO_3H$,
—$\phi'SO_2NH_2$,
—$PO_3H_2$,
—$PO_2H_2$,
—COOH, and
—$\phi'$OH where $\phi'$ is an aryl group.

When the fluorocarbon is one having short side chains, such as poly(perfluoroethylene-trifluorovinyl sulfonic acid) or $\left(CF_2-CF_2\right)_m\left(CF_2-CF(O-CF_2-CF_2SO_3H)\right)_N$, the ratio of M to N, that is, the ratio of the moles of fluorocarbon to the moles of the fluorocarbon acid, is typically about 8, thereby providing an equivalent weight of about 1,000 grams per mole of acid. In the case of such polymers having short side chains, the ratio of M to N is from about 5 to about 20, and preferably from about 6 to about 14. When the ratio of the moles of fluorocarbon to moles of fluorocarbon acid is below about 5, the ion exchange agent shows a decrease in physical strength.

In one preferred exemplification of this invention, the polymer has the empirical formula;

$$\left(CF_2-CF_2\right)_M\left(CF_2-\underset{\underset{SO_3H}{|}}{CF}\right)_N$$

where M and N are as described above.

In another exemplification, the polymer has the empirical formula;

$$\left(CF_2-CF_2\right)_M\left(CF_2-\underset{\underset{\underset{\underset{\underset{\underset{\underset{SO_3H}{|}}{CF_2}}{|}}{CF_2}}{|}}{O}}{CF}\right)_N$$

where M and N are as described above.

In still another preferred exemplification, the polymer has the empirical formula;

$$\left(CF_2-CF_2\right)_M\left(CF_2-\underset{\underset{\underset{\underset{\underset{\underset{\underset{\underset{\underset{SO_3H}{|}}{CF_2}}{|}}{CF_2}}{|}}{O}}{CF_3}}{CF}\right)_N$$

While the membrane is spoken of as being a polymer, polyfunctional perfluoroalkyl acids may also be used in preparing membranes according to this invention. Such polyfunctional perfluoroalkyl acids include those having the empirical formula;

$$A\left(CF_2\right)_q A'$$

where A and A' are acid groups chosen from the group consisting of;

—$SO_3H$,
—$SO_2NH_2$,
—$CF_2SO_3H$,
—$CF_2SO_2NH_2$,
—$CCl_2SO_3H$,
—$CCl_2SO_2NH_2$,
—$\phi'SO_3H$,
—$\phi'SO_2NH_2$,
—$PO_3H_2$,
—$PO_2H_2$,
—COOH, and
—$\phi'$OH where $\phi'$ is an aryl group, and q is greater than 8. A and A' may be the same acid groups or they may be different acid groups. Most frequently, A is —$SO_3H$ and A' is either a second —$SO_3H$ group, a —COOH group, a —$\phi'SO_3H$ group, a —$SO_2NH_2$ group, or a —$\phi'$OH group. While other combinations of acid groups are useful in providing membranes, they are not as readily available and no significant additional benefit is gained by their use. The length of the perfluoroalkyl unit, q, is greater than 8, generally between 8 and 20, and most frequently between 10 and 16. Additionally, ether bonds may be present within the acid, e.g., the formula may be $A-(CF_2)_{q'}-O-(CF_2)_{q''}-A'$ where $q'+q''=q$. While higher molecular weight perfluoroalkyls may be used, they are not generally commercially available.

When, however, the ion exchange resin is polymeric, the fluorocarbon moiety is a fluorinated olefin such as tetrafluoroethylene, hexafluoropropylene, octafluorobutylene, or further homologues thereof. Tetrafluoroethylene is preferred.

There may also be fluorocarbon moieties present in the interpolymer, having as their precursors fluorinated acetylenes such as difluoroacetylene or fluorinated diolefins such as hexafluorobutadine. Such fluoroacetylenes and fluorodiolefins may serve as cross-linking agents cross-linking the fluoroolefin polymers and in that way impart additional strength to the diaphragms of this invention.

The acid moiety

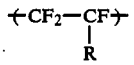

may be a fluoroolefin acid such as the trifluoroethylene acids, the pentafluoropropylene acids, the heptafluorobutylene acids, and further homologues thereof. The pendant group may also be a poly(perfluoroether) or poly (perfluoroalkyl) side chain with a terminal acid group. The pendant acid group A is a cation-selective, ion exchange acid group such as a sulfonic ($—SO_3H$), a sulfonamide ($—SO_2NH_2$), a fluoromethylene sulfonic ($—CF_2SO_3H$), a fluoromethylene sulfonamide ($—CF_2SO_2NH_2$), a chloromethylene sulfonic ($—CCl_2SO_3H$), a chloromethylene sulfonamide ($—CCl_2SO_2NH_2$), a benzene sulfonic ($—\phi'SO_3H$), a benzene sulfonamide ($—\phi'SO_2NH_2$), a carboxylic ($—COOH$), a phosphonic ($—PO_3H_2$), a phosphonous ($—PO_2H_2$), or a phenolic ($—\phi'OH$) acid group. When $\phi'$ is used herein, it refers to the aryl group $—C_6H_4—$.

While the preferred acids are the trifluorovinyl acids, both with and without perfluorinated side chains, it is to be understood that other halocarbon acids may be used with entirely satisfactory results.

The preferred acid groups are the sulfonic acid groups including the benzene sulfonic acid group ($—\phi'SO_3H$), the fluoromethylene sulfonic acid group ($—CF_2SO_3H$), the chloromethylene sulfonic acid group ($—CCl_2SO_3H$), the sulfonic acid group ($—SO_3H$), perfluoro side chains having terminal sulfonic acid groups, and the analogous sulfonamides.

Particularly satisfactory membrane materials are the copolymers of fluoroolefins and trifluorovinyl sulfonic acid. A particularly satisfactory material useful in preparing membranes of this invention is a tetrafluoroethylene and trifluorovinyl sulfonic acid interpolymer, as disclosed, for example, in U.S. Pat. No. 3,624,053 to Gibbs and Griffin for *Trifluorovinyl Sulfonic Acid Polymers.*

While the fluorocarbon described above is illustrated as a polyolefin, it should be noted that other polymeric fluorocarbons may be used with equally satisfactory results. One particularly satisfactory group of materials are the fluorocarbon-fluorocarbon acid vinyl ether polymers, such as those disclosed in U.S. Pat. No. 3,282,875 to Connolly and Gresham for *Fluorocarbon Vinyl Ether Polymers;* British Pat. No. 1,034,197; and German Offenlegungsschrift No. 1,806,097 of D. P. Carlson, based on U.S. Application Ser. No. 697,162, filed Oct. 30, 1967. Disclosed by Connolly and Gresham are fluorocarbon-fluorocarbon acid vinyl ether polymers prepared from monomers having the empirical formula;

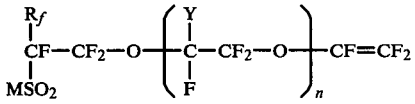

where $R_f$ is a radical selected from the group consisting of fluorine and perfluoroalkyl radicals having from 1 to 10 carbon atoms, Y is a radical selected from the group consisting of fluorine and perfluorinated alkyls having from 1 to 10 carbon atoms, n is an integer from 1 to 3, and M is a radical selected from the group consisting of fluorine, the hydroxyl radical, the amino radical, and radicals having the formula —OMe where Me is a radical selected from the group of alkali metals and the quaternary ammonium radicals.

According to one preferred exemplification, the permionic material is duPont NAFION 390 (TM) which is a multi-layer laminate material. The layer facing the anode is a 4 mil thick layer of 1100 equivalent weight fluorocarbon-fluorocarbon sulfonic acid copolymer, the intermediate layer is a fabric of multi-filament polytetrafluoroethylene fibers on 0.0625 inch centers with equally spaced rayon fibers between each polytetrafluoroethylene fiber, and the layer facing the cathode is a 1.5 mil thick layer of 1500 equivalent weight fluorocarbon-fluorocarbon vinyl sulfonic acid copolymer.

According to still another exemplification of this invention, the permionic membrane has sulfonyl groups on one surface thereof and sulfonamide or sulfonamide salt groups on the opposite side, with the sulfonyl side facing the anolyte and the sulfonamide or sulfonamide salt group facing the acidic catholyte. Such a membrane is described in U.S. Pat. No. 3,784,399 to Grot for *Films of Fluorinated Polymer Containing Sulfonyl Groups With One Surface in the Sulfonamide or Sulfonamide Salt Form and A Process for Preparing Such.*

Alternatively, the membrane may be a permionic material which is degraded by chlorine, such as styrene-divinylbenzene-maleic anhydride.

According to one exemplification of this invention, the process described herein may be carried out in an electrolytic cell having a lead anode and a glass anolyte compartment and a lead cathode and a glass catholyte compartment. The anode and cathode may be separated from each other by a duPont NAFION 390 membrane having one side being a layer of 1.5 mil thick polymer with an equivalent weight of about 1,500 and having the opposite surface being a 4 mil thick polymer with an equivalent weight of about 1,100.

The electrolytic cell may be operated with an anolyte liquor having a 30 weight percent solution of sulfuric acid and an aqueous catholyte liquor of about 45 weight percent hydrogen bromide, about 0.84 weight percent of solubilized bromine, and a separate liquid bromine phase in the catholyte. The cell may then be operated at a current density of about 200 amperes per square foot and a voltage of about 3.5 volts to produce a catholyte product containing 49 weight percent aqueous hydrogen bromide solution containing about 1.82 weight percent bromine, substantially no separate bromine liquid phase, and an anolyte product of oxygen.

EXAMPLE

Bromine was electrolyzed in the cathode chamber of an electrolytic cell to yeidl an aqueous hydrogen bromide solution as follows The electrolytic cell was fabricated of two glass elbows. Each elbow had a 1.5 inch (3.81 centimeter) diameter by 4 inch (10.16 centimeter) long base and a 1.5 inch (3.81 centimeter) diameter by 3 inch (7.62 centimeter) high portion extending upwardly therefrom. The two elbows are clamped together with a membrane between them. The membrane was duPont NAFION® 425 perfluoroethylene $—[CF_2=CF(OCF_2—CF(CF_3))(CF_2CF_2SO_2H)]$ copolymer. The membrane was a 5 mil thick film of 1,200 equivalent weight copolymer.

The anode was a 0.5 inch (1.27 centimeter) by 0.625 inch (1.59 centimeter) by 0.125 inch (0.32 centimeter)

thick lead sheet. The cathode was a 0.5 inch (1.27 centimeter) by 0.625 inch (1.59 centimeter) by 0.06 inch (0.16 centimeter) thick titanium 0.02 weight percent yttrium alloy sheet. The anode was spaced 0.5 inch (1.27 centimeter) from the membrane and the cathode was spaced 0.75 inch (1.9 centimeter) from the membrane.

The process was carried out as a batch reaction. The charge to the catholyte compartment was 124 grams of solution containing 49.1 weight percent hydrobromic acid, 1.82 weight percent $Br_2$ and 20.1 grams liquid bromine.

The anolyte liquor was 186 grams of 30 weight percent aqueous sulfuric acid.

Electrolysis was then commenced at a current density of 220 amperes per square foot (0.237 amperes per square centimeter) and a cell voltage of 3.8 volts. After 3 hours of electrolysis, the fuming catholyte liquor contained 53.2 weight percent hydrogen bromide and 0.74 weight percent dissolved bromine.

While the invention has been described with respect to certain exemplifications and embodiments thereof, the scope is not to be so limited except as in the appended claims.

I claim:

1. A method of producing aqueous hydrogen bromide comprising the steps of:

providing an aqueous catholyte liquor containing a solubilizing amount of hydrogen bromide;

providing an electrically conductive anolyte liquor;

separating said catholyte liquor from said anolyte liquor with a cation perm-selective membrane;

feeding bromine to the catholyte liquor; and passing an electrical current from an anode through said anolyte liquor and catholyte liquor to a cathode whereby to evolve hydrogen bromide.

2. The method of claim 1 wherein said anolyte liquor is an aqueous acid.

3. The method of claim 1 wherein said catholyte liquor contains at least 1.0 gram per liter of hydrogen bromide.

4. The method of claim 1 comprising feeding liquid bromine to the catholyte.

5. A method of producing hydrogen bromide comprising the steps of:

providing an aqueous catholyte liquor containing bromine;

providing an electrically conductive anolyte liquor separated from said catholyte by a permionic membrane; and passing an electrical current from an anode through said anolyte liquor and catholyte liquor to a cathode whereby to evolve hydrogen bromide.

6. The method claim 5 wherein said anolyte liquor is an aqueous acid.

7. The method of claim 5 wherein said catholyte liquor contains a solubilizing amount of hydrogen bromide.

8. A method of producing hydrogen bromide comprising passing an electrical current through an aqueous anolyte liquor to an aqueous catholyte liquor which catholyte is separated from said anolyte liquor by a cation perm-selective membrane and which catholyte liquor contains bromine.

9. The method of claim 8 wherein said anolyte liquor is an aqueous acid.

10. The method of claim 8 wherein said catholyte liquor contains hydrogen bromide.

* * * * *